United States Patent [19]

Pace et al.

[11] Patent Number: 4,518,393

[45] Date of Patent: May 21, 1985

[54] COAL BASED CEMENT COVER FOR COAL PILE

[75] Inventors: Gerald F. Pace; Terry S. Cantu, both of Ponca City, Okla.

[73] Assignee: Conoco Inc., Ponca City, Okla.

[21] Appl. No.: 553,447

[22] Filed: Nov. 21, 1983

[51] Int. Cl.[3] ..... C10L 9/00

[52] U.S. Cl. ..... 44/6; 44/1 R

[58] Field of Search ..... 44/1 R, 6; 427/204, 427/199

[56] References Cited

U.S. PATENT DOCUMENTS 2,328,147 8/1943 Hyson et al. ..... 44/1 R
3,961,914 6/1976 Kindig et al. ..... 44/1 R
4,179,535 12/1979 Kalbskopf et al. ..... 427/206
4,324,562 4/1982 Schoppe ..... 44/6 X

FOREIGN PATENT DOCUMENTS 219772 8/1924 United Kingdom ..... 44/1 R

*Primary Examiner*—Carl F. Dees
*Attorney, Agent, or Firm*—Cortlan R. Schupbach

[57] ABSTRACT

Spontaneous combustion in piles of coal is prevented by forming a slurry of coal fines in an effective amount of sodium silicate solution to form a slurry which is placed on the surface of the coal pile and then allowed to harden into a cement to substantially exclude water and atmosphere.

6 Claims, No Drawings

COAL BASED CEMENT COVER FOR COAL PILE

This invention relates to a process for use in piled coal to make such coal less susceptible to spontaneous combustion. More specifically, the instant invention relates to forming a coal slurry/sodium silicate cement which is placed on the coal pile and allowed to dry to form a substantially water and atmosphere excluding coating over the coal pile.

The rapid growth of electrical demand in the United States and the goals for energy self-sufficiency have all fostered an unprecendented boom in the production of Western low rank, low sulfur, high moisture coals. These coals are now being shipped by trains carrying thousands of tons of such coal to electrical facilities throughout the United States. In addition, such coal is often transported by ship to foreign countries. Low rank coals contain certain severe disadvantages in shipping and storage. Normally, such coals frequently contain 25% or more inherent moisture. Secondly, all coals and especially low rank coals having such high moisture content, have a tendency to ignite spontaneously during shipping or storage. Finally, low rank coals are quite dusty normally, even though such coals may contain up to 25% inherent moisture.

It is well known that such coals are susceptible to oxidation. The grinding of coal, which occurs from particles rubbing against one another during shipping, causes the dust previously mentioned and accelerates such oxidation by exposing new surfaces. Coal storage piles have been destroyed because of spontaneous combustion, which occurs in such coals whether left exposed to weather, as at an electrical facility, or within the holds of ships or in railroad cars during shipment. Spontaneous combustion is caused by the passage of air into the coal pile. Inherent water can effect the rate at which spontaneous heating takes place.

In an article entitled "Self Heating of Carbonaceous Materials" by Shay and Shu of the Great Lakes Research Corporation, Elizabeth, Tenn., setting forth results of tests carried out determining self heating rates of various carbonaceous materials, the authors deal with the effects of moisture and air in the self heating process. The process is illustrated by the behavior of raw lignite which, in the presence of dry oxygen at 150° F. experienced a temperature rise of only 18° F. in about 5 hours, while in the presence of oxygen saturated with water vapor at 150° F., the rate of temperature rise is much greater, the lignite igniting in less than 5 hours.

Even if spontaneous combustion does not occur, another costly effect of coal oxidation is a loss of heating value during storage of reserve fuel piles such as for electrical power. In the case of high volatile matter bituminous coal or even coal of lower rank, loss in btu values during storage can amount to a substantial amount of the original heating value of the coal. For example, a stock of coking coal at a metallurgical coke plant may deteriorate to the point that no satisfactory coke can be produced.

The art proposes to protect coal by coating the surface thereof so as to present impervious physical barriers between the coal and the atmosphere. However, as reported in U.S. Pat. No. 3,288,576, such treatments have been ineffective or uneconomical. Further, with the large volumes of coal being used, it is not economical or satisfactory to attempt to store these materials in a shelter.

It would therefore be of great benefit to provide a method for preventing the spontaneous combustion or decomposition of btu values in a pile or mass of coal in an economical fashion, using easily available materials which can be generally obtained.

It is therefore an object of the present invention to provide such a method for the prevention of spontaneous combustion in piles of coal. Other objects will become apparent to those skilled in this art as the description proceeds.

We have now discovered according to the present invention a method for prevention of spontaneous combustion in a pile or mass of coal made up of heterogenous particles free from each other comprising (a) forming a slurry of coal from coal fines, a carrier and an effective amount of sodium silicate, (b) placing the slurry formed on the surface of said coal pile in sufficient quantity that the slurry penetrates the coal pile to a depth sufficient to substantially exclude atmospheric air, and (c) allowing the slurry to dry to form a hard sodium silicate-coal cement.

In a preferred embodiment the carrier used is simply water, and both water and sodium silicate are economical to use and freely available in most areas.

The prior art contains many references to sodium silicate in an attempt to prevent combustion in coal. However, in general, these references deal with sealing coals which are not to be burned, since sodium is a known detrimental material to coal combustion processes when it is present in the ash at concentrations higher than 3 weight percent as $Na_2O$. At these concentrations, the melting point of the ash is lowered, and causes subsequent slagging problems in combustion, causing sticky, heatinsulating contamination in heat-transfer apparatus. Representative but non-exhaustive examples of such references include an article entitled "Study of the Effectiveness of Combustion Inhibitors" KHIM, TVERD. TOPL. (Moscow) 1977, by Polyanskaya. In this reference a 5% solution of sodium silicate ($Na_2Si_4O_9$) was used as a 5% solution on coal mine walls to decrease fire hazards from spontaneous combustion of such walls. However, such walls are not recovered as fuel, and the detrimental aspects of this material are not therefore noted. An article entitled "Inhibitor for Preventing Spontaneous Combustion of Coals and Mechanism of Inhibition", Peng, Ben-Xin, Fushion Research Institute, Central Coal Mine Research Institute, People's Republic of China, Mei T'an Hsueh Paol, (1980) reported that various coals were oxidized in the presence of inorganic substances and the amount of carbon monoxide generated was measured. Sodium silicate (or "water glass") was the best oxidation inhibitor. However, this material was added directly to the coal and coated each and every particle.

U.S. Pat. No. 4,214,875 coats coal piles with coating compositions comprising an organic binder, a synthetic organic polymer and an organic filler such as coal fines. U.S. Pat. Nos. 2,204,781 and 3,288,576 relate to treatment of coal piles with coating compositions to prevent the coal from auto oxidation and spontaneous combustion. However, these references utilize relatively expensive materials. U.S. Pat. No. 4,214,875 utilizes a slurry containing 65 to 85% coal fines and 15 to 35 "binders" which are comprised of wax, tar, asphalt pitch or mixtures of these, together with an optional organic polymer. U.S. Pat. No. 2,204,781 requires a coal pile to be first covered with coal fines to fill large interstices and then covering with wax. U.S. Pat. No. 4,179,535 describes a process for fireproofing structures utilizing a slurry of water glass and fiber material such as asbestos to form a coating which foams at temperatures of about 250° C. to form a fireproof foam structure.

However, none of these references provide a low cost, efficient method for coating coal piles to prevent spontaneous combustion or to prevent spread of spontaneous combustion already underway.

The instant invention solves these problems by providing a coal base cover for coal piles which contain as additives only a binder material, preferably water, and sodium silicate together with coal fines which are present in abundance near large stores of coal. These materials are mixed in the proper proportions to form a thick slurry which is adhesive, durable and impermeable after drying. Alternatively, coal can be pulverized if necessary using simple equipment, which together with sodium silicate and water forms a very effective slurry when applied to the surface of samples. This slurry penetrates the void volume of the coal pile to the depth of at least ¼ inch and as much more as desired or necessary to completely form an impervious barrier. The slurry when dry is a somewhat cohesive mass which forms a hard, concrete-like cover around the coal pile and prevents substantial entrance of atmosphere and water to the depths of the coal pile. Water absorbed into the slurry dries after any rain has ceased. The cover remains substantially oxygen impermeable and prevents spontaneous combustion by such oxygen exclusion.

The instant invention functions in part by preventing the well known "chimney" effect of moisture, high temperature in coals together with a constant supply of oxygen as represented by a breeze or wind. Such moving air carries more and more oxygen to the heated area which provides more and more heat and, using a feedback mechanism, rapidly spontaneously combusts the coal pile. The instant invention substantially stops the flow of oxygen, even to moist coal, and thus prevents the chimney effect and effectively prevents and/or smothers spontaneous combustion occurring in the depths of the coal pile.

Carrying out the present invention, coal fines used should be as small as possible but will normally pass about a −65 mesh and when mixed with water, the coal fine/water slurry has a ratio of coal fines to water ranging from about 50-50 to about 90-10 respectively, but from about 45-55 to about 70-30 respectively are preferred. To this slurry is then added sodium silicate in a concentration ranging from about 0.5% by weight to about 20% by weight based on the total weight of the slurry. Preferred levels range from about 5% by weight to about 10% by weight, and from about 6% by weight to about 9% by weight are most preferred.

Once the coal pile coated by the slurry of the present invention is used, a fresh coal face will be exposed as coal is removed for combustion. If the pile is to be left unattended for long periods of time, it may be necessary to recoat the fresh portion of the face with the slurry of the present invention in order to prevent spontaneous combustion.

The slurry of the present invention is combustible and the well known detrimental qualitites of sodium and silicon on the coal are not noticeably present when combusting coal piles covered by the method of the present invention, since these materials are present in such small quantities that no effect is seen. For example for a 40,000 ton coal pile, sodium silicate used at a level of 12.5 pounds coal-based slurry per ton of coal in the pile at 6.8% sodium silicate in the slurry, would provide a one inch penetration or barrier. The amount of sodium added in this example by the method of the present invention is calculated by $$\frac{12.5\ \frac{\text{lb slurry}}{\text{ton of coal}} \times 0.068\ \frac{\text{lb } Na_2SiO_3}{\text{lb slurry}} \times 0.508\ \frac{\text{lb } Na_2O}{\text{lb } Na_2SiO_3}}{(2000\text{ lb coal/ton coal}) \times (0.1\text{ lb ash/lb coal})} \times 100 = 0.216\%\ Na_2O \text{ in the ash,}$$

assuming that the "coal-based cover" material has been evenly distributed throughout the coal pile at the time of coal combustion. Thus the present invention prevents spontaneous combustion in a simple efficient, inexpensive manner while adding less than 0.5% sodium to the total coal treated. The sodium added is sufficiently low that no detrimental effects are seen during combustion.

The instant invention is more concretely described with reference to the examples below wherein all parts and percentages are by weight unless otherwise specified. The examples are provided to illustrate the present invention and not to limit it.

EXAMPLE 1

A solution of sodium silicate was mixed with fine coal to form a slurry and applied to the surface of a sample of cleaned coal. The slurry penetrated the void volume of the coal samples near the surface to form a depth necessary to maintain a continuous cover. The slurry was allowed to dry and formed a cohesive mass which sealed around the coal particles of the sample coal pile near the surface and provided an effective barrier to air flow.

Four separate tests were carried out using a basic slurry of 100 grams pulverized coal (−65 mesh), 30 grams of 1.4 specific gravity, 36 weight percent sodium silicate solution together with varying amounts of water. The slurry obtained was applied to a 57 square centimeter area. The coal-base cover was observed to have noticeable cracks but no fractures, impermeability with even distribution, and some cohesion to the coal particles. The results are set forth in Table 1 below.

TABLE 1

| Test No. | Measured Average Slurry Penetration Into Pile (Inches) | Coal (wt %) | $H_2O$ (wt %) | Sodium Silicate (wt %) |
|---|---|---|---|---|
| 1 | 0.75 | 59.5 | 33.7 | 6.8 |
| 2 | 1.5 | 56.4 | 37.2 | 6.4 |
| 3 | 5.0 | 53.2 | 40.7 | 6.1 |
| 4 | 2.5 | 54.9 | 38.8 | 6.3 |

EXAMPLE 2

Evaluating the present invention, a 40,000 ton coal pile, 300 feet square with a height of 17.7 feet at an angle of repose of 37° is utilized as a base case. The approximate exposed surface area for this case is 2.5 square feet per ton of coal. The amount of base materials which requires different cover thicknesses is set forth in Table 2. In the table the term "superficial" describes the depth of the slurry assuming no penetration. The calculated penetration is the actual depth the slurry penetrates into the coal, based on the void volume of the coal pile.

TABLE 2

| Percent of Coal-Based Material | Amount of Coal-Based Material | Superficial Coal-Based Material Thickness | Calculated Penetration into Coal Accumulation 0.35 Void Fraction |
|---|---|---|---|
| 0.625 | 12.5 lb/ton | 1.00 inch | 2.86 inch |
| 0.312 | 6.2 lb/ton | 0.50 inch | 1.43 inch |
| 0.156 | 3.1 lb/ton | 0.25 inch | 0.71 inch |
| 0.063 | 1.3 lb/ton | 0.10 inch | 0.29 inch |

Use of the present invention allows the elimination of pile trimming as a method of controlling spontaneous heating. Pile trimming requires heavy equipment to compress the coal to obtain a higher bulk density of the coal pile, removes interstices and prevent air flow. This method is inappropriate in many cases and has obtained only limited success while requiring significant cost. The instant invention likewise improves upon the known art for covering coals by using a base material which is easily obtainable (coal fines) together with other commonly available materials which are low in cost (water, sodium silicate) and therefore allows on site, convient, efficient, low-cost protection of large coal piles. The instant process utilizes as the source of the base materials the coal itself, such that the cost of the base material is minimized. Further, this covering can be easily consumed during normal combustion processes.

While certain embodiments and details have been shown for the purpose of illustrating this invention, it will be apparent to those skilled in this art that various changes and modifications may be made herein without departing from the spirit or scope of the invention.

We claim:

1. A method for prevention of spontaneous combustion in a pile or mass of coal made up of heterogeneous particles substantially free from one another by covering said coal pile or mass, comprising (a) forming a slurry of coal from coal fines, a carrier and an effective amount of sodium silicate, (b) placing the slurry formed on the exposed surface of said coal pile in sufficient quantity that the slurry penetrates the coal pile to a depth sufficient to substantially exclude atmospheric air, and (c) allowing the slurry to dry to form a hard, sodium silicate-coal cement, wherein the total sodium present based on the coal covered is sufficiently low to avoid slagging during combustion.

2. A method as described in claim 1 wherein the carrier is water.

3. A method as described in claim 2 wherein the coal fines/water slurry has a ratio of coal fines to water ranging from about 50-50 to about 90-10, respectively.

4. A method as described in claim 3 wherein the coal fines to slurry ratio is about 70/30 respectively.

5. A method as described in claim 4 wherein the sodium silicate is added to the slurry at a concentration ranging from about 0.5% by weight to about 20% by weight based on the total weight of the slurry.

6. A method as described in claim 5 wherein the slurry is placed on the coal to a superficial depth of at least 1 inch.

* * * * *